US006071212A

United States Patent [19]

Hödlmoser

[11] Patent Number: 6,071,212

[45] Date of Patent: Jun. 6, 2000

[54] GYMNASTIC EQUIPMENT FOR VAULTING EXERCISES

[75] Inventor: Helmut Hödlmoser, Leonding, Austria

[73] Assignee: Spieth Gymnastic GmbH, Esslingen, Germany

[21] Appl. No.: 09/089,366

[22] Filed: Jun. 3, 1998

[30] Foreign Application Priority Data

Jun. 19, 1997 [DE] Germany ..... 197 26 019

[51] Int. Cl.[7] ..... A63B 5/12

[52] U.S. Cl. ..... 482/25; 482/31; 482/32

[58] Field of Search ..... 482/25–32, 130; 297/302.1, 325, 452.39; 472/103

[56] References Cited

U.S. PATENT DOCUMENTS

| | | | |
|---|---|---|---|
| 1,514,037 | 11/1924 | Deluca | 482/25 |
| 4,093,209 | 6/1978 | Daly . | |
| 5,551,758 | 9/1996 | Leib et al. | 297/452.39 |

FOREIGN PATENT DOCUMENTS

| | | | |
|---|---|---|---|
| 989891 | 5/1976 | Canada | 482/31 |
| 446381 | 7/1927 | Germany . | |
| 29 44 840 | 5/1980 | Germany . | |
| 151110 | 10/1981 | Germany | 482/25 |
| 34 26 112 | 5/1985 | Germany . | |
| 253372 | 1/1988 | Germany . | |
| 1131515 | 12/1984 | U.S.S.R. | 482/25 |
| 1636000 | 3/1991 | U.S.S.R. | 482/25 |
| 680504 | 10/1952 | United Kingdom | 297/302.1 |

*Primary Examiner*—Richard J. Apley
*Assistant Examiner*—Victor Hwang
*Attorney, Agent, or Firm*—Browdy and Neimark

[57] ABSTRACT

A gymnastic apparatus for performing vaults possesses a lower portion, an upper part arranged on same in a vertically adjustable fashion and constituted by a board arranged in a resilient manner on the lower portion. A gymnast running toward a front side of the apparatus, places his hands on the top side of the board, which forms a support face, applies his weight for an instant and leaps over the apparatus. In such leap he is aided by the resilient board. A front region of the board rises from the front convexly toward the rear in a arcuate manner, the arcuate region merging with an approximately horizontal flat region. The transitional region and/or the flat region serves a support face.

19 Claims, 1 Drawing Sheet

GYMNASTIC EQUIPMENT FOR VAULTING EXERCISES

BACKGROUND OF THE INVENTION

The invention relates to gymnastic equipment for the performance of vaulting exercises, in the case of which the gymnast takes a run toward the front end of the equipment, supports himself with his hands for an instant on the equipment and leaps over it from the front to the back thereof, comprising an upper part held up by a lower portion, said upper part having an upper surface forming a support face for the hands of the gymnast.

Conventional vaulting horses possess a horse body with a beam-like, elongated shape as an upper part and four legs at the corner parts of the horse body as a lower portion or frame. Such horses are placed parallel to the direction of the run in the case of men's gymnastics and athwart it for women. In the former case there is a support face which is long in the direction of vaulting but is narrow whereas in the latter case although the support face is broad it is extremely short. This comparatively small support face is not free of danger and if the gymnast misses his hold a serious injury may be the result.

Furthermore although vaulting horses are padded on their top side constituting the support face, more particularly the wrists of the gymnast will be subject to comparatively heavy jerks.

Known vaulting horses are moreover comparatively cumbersome and extravagant in the amount of space required.

SHORT SUMMARY OF THE INVENTION

Consequently one aim of the present invention is to provide gymnastic equipment of the type initially mentioned with which vaulting exercises may also be performed, for both men's and also women's exercises without changing the direction of the equipment. Furthermore the risk of injury to the gymnast is to be low. A further aim is for the new design of gymnastic equipment to provide a handy and space saving structure.

In order to achieve these and/or other objects appearing from the present specification, claims and drawings, in the present invention the upper part is constituted by a board mounted on the lower portion for resilient motion, such board having a front region rising in a convex arcuate manner upward at the front toward the rear, the arcuate region merging in a transitional region with an approximately horizontal flat region and such transitional region and/or the flat region being adapted to serve as a support face.

Such equipment constitutes more or less a vaulting or leaping table, whose board may have such dimensions that even if he gets into an awkward position the gymnast is not able to miss his hold. Furthermore a substantially shorter design than with a conventional vaulting horse is fully sufficient so that the space requirement is smaller. A further point is that the support face gives way yieldingly when the gymnast bears against it so that there is a certain degree of damping and furthermore the gymnast benefits from a useful reinforcing effect as regards the achievable height and length of his vault owing to the rebound of the board.

A particularly high degree of safety for the gymnast is provided by the front region which rises arcuately. Should the gymnast break off his vault for some reason or other or if he should make a bad initial jump onto the equipment so that he collides with the front side thereof, he will strike the front board part with his breast so that the forces occurring are substantially better distributed than in a case in which he slams up against a vertical impact face and/or an edge.

The arcuate region and its smooth transition with the horizontal flat region involves a further advantage to the extent that the gymnast has a choice of different points with different slopes for putting his hands on and supporting himself so that every gymnast will be able to select the position which is best for him and the particular exercise he is doing.

Further advantageous developments of the invention are defined in the claims.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
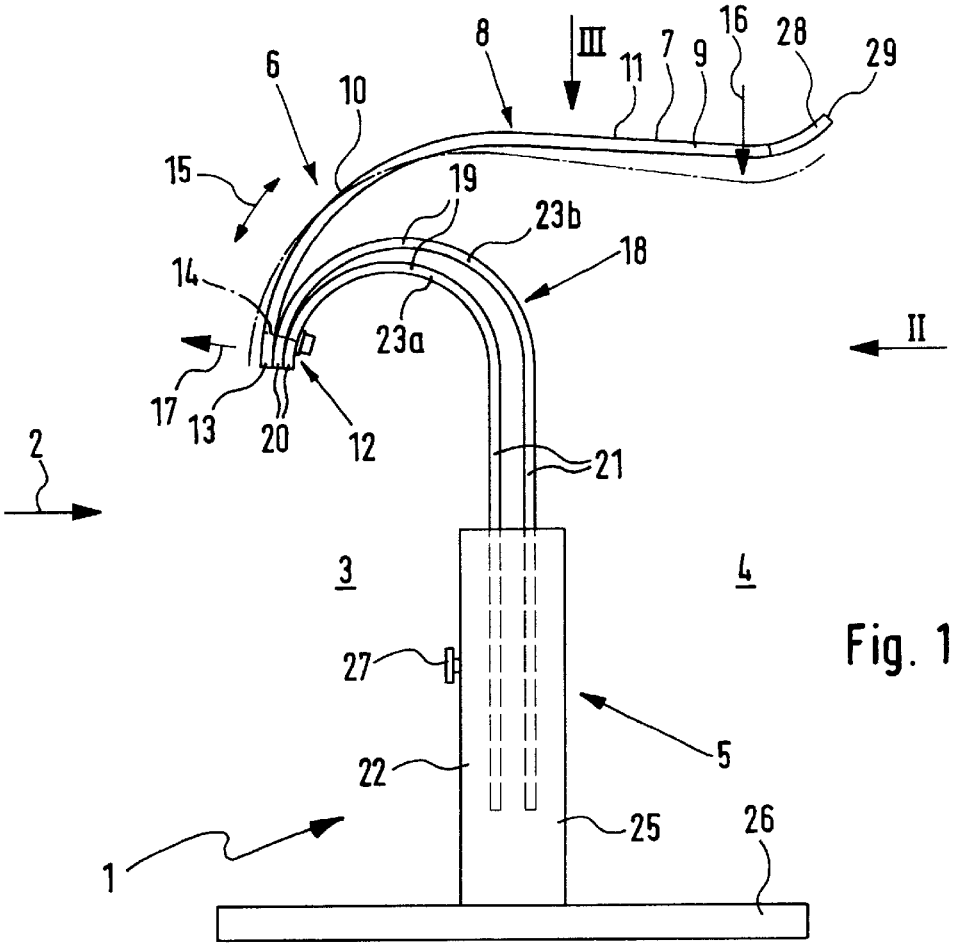
FIG. 1 shows the gymnastic equipment of the invention in a diagrammatic lateral elevation.

The gymnastic equipment 1 appearing in the drawings rests on the ground during use in the position indicated in FIG. 1. It serves for the performance of vaulting exercises, in which the gymnast runs as indicated by the arrow 2 toward the front side 3 or end of the equipment, places his stretched out hands on the equipment, supports himself briefly thereon and then moves clear of the equipment to the rear, moving over the rear side 4 of the equipment. The gymnast thus leaps over the equipment as a prolongation of his run-up toward the equipment in the direction of the arrow 2 from the front to the back of the equipment performing the respective vault each time.

The gymnastic equipment 1 possesses a lower portion 5 and an upper part 6 held up by the latter, such upper part 6 forming a support face 8 on its top side 7, for the gymnast to apply both hands to. The exact point at which the gymnast applies his hands to the support face 8 will be dependent on the gymnast and the respective vault exercise he is performing.

The upper part 6 is constituted by a board 9 arranged in a resilient fashion on the lower portion 5, the front region 10 of the board 9 rising convexly in an arcuate manner toward the rear and merging into a generally horizontal flat region 11. The transitional region between the arcuate region 10 and the flat part 11 and/or the flat region itself 11 may serve as a support face 8 for the gymnast.

The gymnastic equipment 1 more or less constitutes a vaulting or leaping table with the board 9 as the table top. The region constituting the support face 8 of the board 9 is located at a height of approximately 1 m to 1.4 m, that is to say generally at chest level, the exact level being dependent on the height of the gymnast. The arcuate region 10 with a slope decreasing from the front to the back safeguards the gymnast if he should collide with the apparatus. The arcuate region 10 ceases at the front bottom part, that is to say, there is no region protruding to the front which might increase the danger of injury to a gymnast. A gymnast colliding against the arcuate region 10 may slide onto the arcuate region so that the collision will be rendered less severe. It is convenient for the board 9 to have its arcuate region 10 secured to the lower portion 5 and for it to extend from the point 12 of attachment in a cantilever fashion to the rear so that the board 9 constitutes an arrangement like a springboard. If the gymnast places both his hands on the board 9, same will yield elastically as is in this case indicated in chained lines in FIG. 1. Such resilient behavior leads to a sort of shock absorbing effect upon the impact of the gymnast and will aid him with the following leap.

The board 9 has its front lower end region 13 secured to the lower portion 5. This may be ensured using mounting screws 14 indicated in chained lines. In this respect the board 9 has its lower side, which is opposite to the top side 7, applied to the lower portion 5.

In this connection it is convenient for the board 9 to be connected with the lower portion 5 to allow adjustment backward and forward. On loosening the attachment screws 14 the board 9 may have its arcuate region 10 moved in the arcuate direction 15 and then locked in the respective desired setting again. Such adjustment will mean that the slope of the board 9 will be changed so that same may be set to the desired slant.

A further convenient design is such that the attachment point 12, at which the board 9 is secured is arranged in a resilient fashion on the lower portion 5 in such a manner that the lower front end region 13 of the board 9 swings upward and forward somewhat, when the gymnast applies his weight to the board 9. In FIG. 1 the shape and position of the board 9 assumed under load is indicated in chained lines. There is hence a double resilient action, on the one hand due to the inherent elasticity of the board 9 and on the other hand due to the arrangement of the board 9 on a resilient part of the lower portion 5. The result of this is that the board 9 is deflected downward at the rear (arrow 16) and at the front somewhat upward (arrow 17). That is, the board 9 rotates slightly.

In the embodiment the board 9 is secured to a strip spring arrangement 18 forming part of the lower portion 5. In this respect the strip spring arrangement 18 preferably constitutes a resilient arc 19 which in lateral view is opposite to the lower side of the arcuate board region 10, such arc 19 extending from its free end region 20, which bears the board 9, in the same direction but with a greater curvature than the curved front board region 10 to the rear. The resilient arc 19 hence extends away from the board 9 behind the point 12 of attachment so that its resilient downward bending movement to the full extent as indicated by the arrow 16 is not hindered.

During resilient deformation of the board 9, when the gymnast grips same and applies his weight thereto, the resilient arc 19 will unbend somewhat so that the forwardly directed pivot motion in accordance with arrow 17 of the front board end region 13 will conform to this elastic upward bending of the resilient arc 19.

As seen from the side the strip spring arrangement 18 preferably generally has the geometry of an inverted letter J and adjacent to this constitutes at its resilient arc 19 a linear region 21, which extends vertically and is secured to the remaining part of the lower portion 22.

It will be furthermore seen from the drawing that the strip spring arrangement 18 is constituted by two pairs, arranged at the distance a apart, of strip elements 23*a* and 23*b* and, respectively, 24*a* and 24*b*. In the case of each pair the two strip elements 23*a* and 23*b* and furthermore 24*a* and 24*b* are superposed as seen in plan view and in side view extend alongside each other (FIG. 1), the two strip elements 23*a* and 23*b* and furthermore 24*a* and 24*b* being arranged on top of one another at the respective point of attachment 12 to the board 9 and following this then draw away from each other along the resilient arc 19 so that their linear, vertically extending regions 21 are arranged on the remaining lower portion 22 at a distance apart.

It will be clear that instead of the two strip elements it would be feasible to provided only one pair of strip elements, which would then be made with a suitable strength. Furthermore the strip elements do not have to be provided in pairs, since furthermore given a suitable cross section a single strip element would be sufficient. The paired arrangement of the strip elements 23*a*, 23*b*, and, respectively, 24*a*, 24*b* leads to a somewhat improved attachment of the strip spring arrangement on the rest of the lower portion 22.

In the case of each pair of strip elements it is possible for the two strip elements 23*a*, 23*b* and, respectively, 24*a*, 24*b*, as already mentioned, to have their end regions resting on top of one another. They can be welded together here or for example be screwed together with the aid of screws, for which purpose the respective attachment screw 14 may be employed, which is utilized to secure the board 9 in place.

The strip spring arrangement 18 is consequently constituted by at least one strip element. As a material for this purpose metal is more particularly suitable.

The board 9 is arranged so that it may be adjusted in height. For this purpose it is possible for the linear, vertically extending region 21 of the strip spring arrangement 18 to be attached to the rest of the lower portion in a vertically adjustable fashion.

The lower portion 5 may conveniently possess a stand 25 extending essentially centrally underneath the board 9, such stand 25 having foot-like legs 26 resting against the floor. In the illustrated working embodiment the stand 25 constitutes the remaining lower portion 22, the linear part 21 of the strip spring arrangement 18 extending down into the stand 25 and running therein in a vertically adjustable manner. A setting device able to be operated with a handle 27 serves to lock the strip spring arrangement 18 at the respectively selected level. Only the handle 27 of the locking device is illustrated. It can for example be a question of a clamping means.

In accordance with a further convenient feature the rear end region 28 of the board 9 is bent up somewhat in an arcuate manner as seen in side view. This upwardly bent end region 28 adjoins the flat region 11. The upwardly bent end region 28 will clearly indicate to the gymnast where the board 9 ends at the rear. Furthermore it prevents any unintended sliding of the gymnast to the rear.

Figure 2:
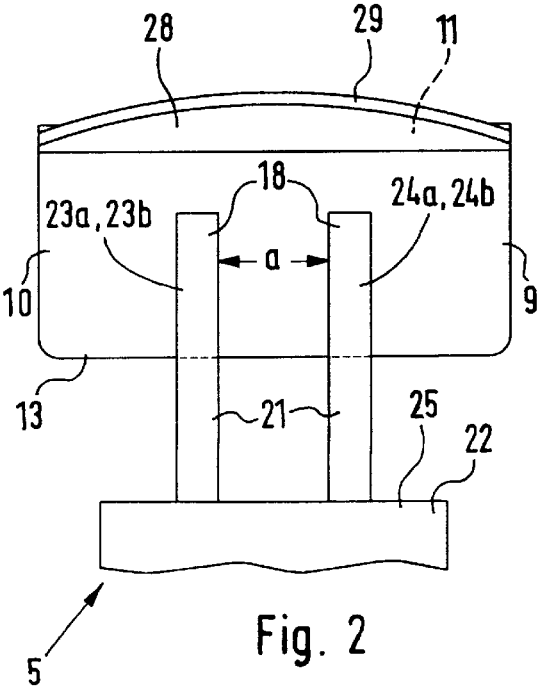
FIG. 2 shows part of the gymnastic equipment of FIG. 1 in a diagrammatic rear view looking in the direction of arrow II.
Figure 3:
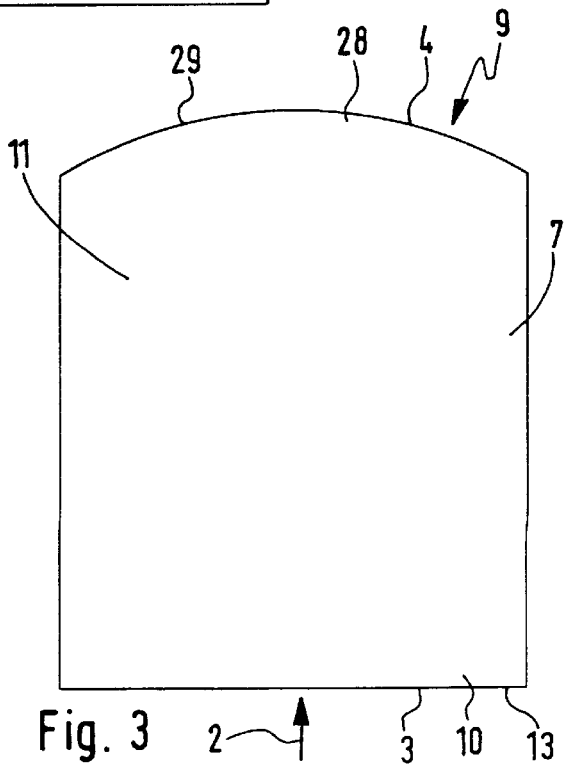
FIG. 3 shows the gymnastic equipment of FIGS. 1 and 2 in a diagrammatic plan view looking in the direction of the arrow III in FIG. 1.

As shown in FIGS. 2 and 3 it is possible for the rear board edge 29 to be curved in a convex arc so that in the middle of the board it is somewhat higher than at the sides of the board.

The board 9 can possess a square or rectangular configuration. More particularly FIG. 3 indicates that as seen in plan view the board 9 is only a little larger toward the rear than in the direction at a right angle thereto. It is naturally possible for these dimensions to be somewhat different, it being convenient for the board 9 to be more than twice as large in the one direction than in the other direction.

In principle the board 9 may be manufactured of different material. It is convenient in this case for the board 9 to be a plate or board of plastic and more especially glass fiber reinforced material or sheet metal with an upper surfacing layer. The board 9 could however also be manufactured of wood as well.

What is claimed is:

1. A gymnastic apparatus for a gymnast having hands to perform a vault wherein the gymnast runs toward a front side of the apparatus, leaps over the apparatus toward a rear side of the apparatus, and briefly supports himself or herself by placing the hands onto the apparatus;

the apparatus comprising:

an upper part comprising a board comprising an upper surface, an approximately horizontal flat region, a downward-curving arcuate region, and a transitional region between the arcuate region and the flat region; the upper surface of the flat region and the transitional region comprising an upper support face adapted to support the hands of the gymnast;

a lower portion comprising a resilient strip spring wherein the arcuate region of the board is resiliently mounted in cantilever fashion to the strip spring;

the strip spring having a linear vertically extending region mounted on a remaining lower portion of the lower portion;

whereby the board rotates slightly when depressed by the hands of the gymnast.

2. The gymnastic apparatus as set forth in claim 1, wherein the board includes a lower front end region attached to the lower portion.

3. The gymnastic apparatus as set forth in claim 2, wherein a point at which the arcuate strip spring is secured to the arcuate region of the board is arranged in a resilient fashion on the lower portion in such a manner that the lower front end region of the board swings upward and forward somewhat when the gymnast applies his weight to the board.

4. The gymnastic apparatus as set forth in claim 3 wherein the strip spring comprises an arrangement of at least one strip spring element.

5. The gymnastic apparatus as set forth in claim 4, wherein the strip spring arrangement as seen in side view generally has the form of an inverted letter J and adjoining its resilient arc has a linear region, which extends vertically and is secured to a remaining lower portion and wherein the strip spring arrangement is constituted by at least one pair of strip spring elements, which overlap in plan view and in side view extend alongside one another, the two strips being arranged on top of each other at the point of securement of the board and then extend away from one another so that their linear vertically extending regions secured to the remaining lower portion are arranged with a distance between them.

6. The gymnastic apparatus as set forth in claim 5, comprising two pairs, arranged in a transverse direction with a distance between them, of strip spring elements.

7. The gymnastic apparatus as set forth in claim 1, wherein the board is connected with the lower portion to allow adjustment backward and forward.

8. The gymnastic apparatus as set forth in claim 1, wherein the board includes a lower side thereof secured to the lower portion.

9. The gymnastic apparatus as set forth in claim 1, wherein the board is arranged in a vertically adjustable fashion.

10. The gymnastic apparatus as set forth in claim 9, wherein the linear vertically extending region of the strip spring is mounted in a vertically adjustable manner on the remaining lower portion.

11. The gymnastic apparatus as set forth in claim 1, wherein a rear end region of the board is bent upward in an arcuate manner.

12. The gymnastic apparatus as set forth in claim 11, wherein the rear board end region as seen in plan view has an arcuately and convexly extending outline.

13. The gymnastic apparatus as set forth in claim 1, wherein the board includes a square or rectangular configuration.

14. The gymnastic apparatus as set forth in claim 1, wherein as seen in plan view the board is of such a size in the front to rear direction and in the transverse direction that in the one direction it is not more than twice as large as in the other direction.

15. The gymnastic apparatus as set forth in claim 1, wherein the board comprises at least one of plastic, glass fiber reinforced material, and sheet metal; the board including an upper surfacing layer.

16. The gymnastic apparatus as set forth in claim 1, wherein the lower portion includes a stand arranged essentially centrally underneath the board.

17. The gymnastic apparatus as set forth in claim 1, wherein the strip spring is arcuate.

18. A gymnastic apparatus for performing vaults, in the case of which a gymnast is to take a run toward a front side of the apparatus, to vaultingly support himself by his hands on the apparatus briefly and to leap over the apparatus to the rear, comprising an upper part having an upper support face for the hands of the gymnast and a lower portion holding up such upper part, wherein the upper part is constituted by a board mounted on the lower portion for resilient movement, such board having a front arcuate region rising in a convex arcuate manner upward at the front toward the rear, the arcuate region merging in a transitional region with an approximately horizontal flat region and such transitional region and/or such flat region adapted to serve as a support face;

wherein the board has the arcuate region secured to said lower portion and extends in a cantilever fashion to the rear so that it comprises a strip spring arrangement;

wherein a point of attachment of the lower portion to the board is arranged in a resilient fashion on the lower portion in such a manner that a lower front end region of the board swings upward and forward somewhat when the gymnast applies his weight to the board;

wherein said lower portion includes a strip spring to which the board is secured;

wherein the strip spring arrangement constitutes a resilient arc, such resilient arc extending backward from its free end region, which bears the board, in the same direction and with greater curvature than the curved arcuate region.

19. The gymnastic apparatus as set forth in claim 18, wherein the strip spring arrangement as seen in side view generally has the form of an inverted letter J and adjoining its resilient arc has a linear region, which extends vertically and is secured to a remaining lower portion.

* * * * *